US006772965B2

(12) United States Patent
Yildirim et al.

(10) Patent No.: US 6,772,965 B2
(45) Date of Patent: Aug. 10, 2004

(54) FUEL INJECTION VALVE

(75) Inventors: Fevzi Yildirim, Gerlingen (DE); Guenther Hohl, Stuttgart (DE); Michael Huebel, Gerlingen (DE); Norbert Keim, Loechgau (DE)

(73) Assignee: Robert Bosch GmbH, Stuttgart (DE)

( * ) Notice: Subject to any disclaimer, the term of this patent is extended or adjusted under 35 U.S.C. 154(b) by 209 days.

(21) Appl. No.: 10/070,967

(22) PCT Filed: Jul. 13, 2001

(86) PCT No.: PCT/DE01/02541

§ 371 (c)(1),
(2), (4) Date: Jul. 2, 2002

(87) PCT Pub. No.: WO02/06664

PCT Pub. Date: Jan. 24, 2002

(65) Prior Publication Data

US 2002/0179742 A1 Dec. 5, 2002

(30) Foreign Application Priority Data

Jul. 15, 2000 (DE) ..... 100 34 445

(51) Int. Cl.[7] ..... F02M 39/00; F02M 61/20; B05B 1/30

(52) U.S. Cl. ..... 239/533.3; 239/88; 239/533.13; 239/533.9; 239/585.5; 239/585.4

(58) Field of Search ..... 239/456, 458, 239/459, 396, 88–92, 533.2, 533.9, 533.12, 533.13, 533.14, 585.1, 585.2, 585.3, 585.4, 585.5; 251/129.15, 129.21

(56) References Cited

U.S. PATENT DOCUMENTS 5,642,862 A * 7/1997 Wakeman et al. ..... 239/585.4
5,692,723 A * 12/1997 Baxter et al. ..... 251/129.21
5,758,865 A * 6/1998 Casey ..... 251/129.21

FOREIGN PATENT DOCUMENTS

| | | |
|---|---|---|
| DE | 926 643 | 4/1955 |
| DE | 30 48 304 | 7/1982 |
| DE | 31 20 044 | 12/1982 |
| DE | 32 28 079 | 2/1984 |

* cited by examiner

*Primary Examiner*—Davis Hwu
(74) *Attorney, Agent, or Firm*—Kenyon & Kenyon

(57) ABSTRACT

A fuel injector, e.g., an injector for fuel injection devices in internal combustion engines, has a valve needle with a valve-closure member which cooperates with a valve seat surface in a valve seat body to form a sealing seat, in which the valve seat body has a plurality of injection orifices that are isolated from the fuel supply by sealing seat. The valve-closure member has a pressure element in a recess facing the valve seat body, which is pre-tensioned against the valve seat body by a spring which is supported on the valve-closure member and presses a disc spring against the valve seat body, in such manner that the disc spring covers at least one of the injection orifices, and the spring element uncovers this injection orifice when the tension exerted by the pressure element is removed.

11 Claims, 1 Drawing Sheet

FUEL INJECTION VALVE

FIELD OF THE INVENTION

The present invention relates to a fuel injector.

BACKGROUND INFORMATION

German Published Patent Application No. 32 28 079 A1 describes a fuel injector having two valve needles with which it is capable of controlling multiple injection orifices individually. Each valve needle is pre-tensioned against a respective sealing seat by a spring. If one needle is raised out of its sealing seat by a certain clearance, it strikes against a stop of the other valve needle and takes the second valve needle with it as the travel progresses. The two sealing seats of the two valve needles close different injection orifices, which may be directed at differing angles. However, the construction is made up of multiple parts and two sealing seats must be manufactured to precise specifications, which gives rise to high costs.

German Published Patent Application No. 30 48 304 A1 describes a fuel injector for internal combustion engines having a valve needle and a secondary needle in a borehole in the valve needle. The portion of the valve needle which, near the combustion chamber is configured as a valve-closure member, cooperates with a valve seat surface to form a sealing seat that isolates injection orifices from the fuel inlet. The secondary needle which is guided in the valve needle also has a valve-closure member, which cooperates with a second valve seat surface of the fuel injector. The secondary needle is drawn towards the valve needle by a spring that is located in the valve needle, and it also forms a sealing seat against the valve needle with a valve seat surface in the valve needle. When the hydraulically actuated fuel injector begins to open as a result of rising pressure in the fuel supply line, the secondary needle is forced out of its sealing seat in the valve needle and towards the sealing seat in the valve body and closes a group of injection orifices, while another group of injection orifices is opened. If the pressure continues to rise, the valve needle is raised out of its sealing seat and after a certain travel takes the secondary needle with it, the secondary needle striking against a stop of the valve needle. All injection orifices are then opened. The disadvantage of this arrangement is that in all three sealing seats must be produced to exact specifications.

German Published Patent Application No. 31 20 044 C2 also describes a fuel injector having two valve needles, which may be used to open injection orifices in two groups. In this arrangement, one valve needle is disposed inside the other, which is constructed as a hollow valve needle. The valve needle which is designed as a hollow needle has injection orifices in its end near the combustion chamber. The disadvantage of this arrangement is that the production of the hollow needle is highly labor-intensive since it also has injection orifices, so that two functions, are combined in a single component, each requiring that the component be produced to a high degree of precision.

SUMMARY

The fuel injector according to the present invention may have the advantage that it provides a solution for sequentially opening groups of injection orifices in a manner that may be inexpensive and easily manufacturable, since the additional group of injection orifices may not require an additional sealing seat manufactured with a high degree of precision in order to be able to open separately. For Example, the angle over which the fuel is distributed in the fuel injector's jet pattern may be adjustable as a function of the valve lift.

A first circle of injection orifices may be covered by tongues in the disc spring. Further injection orifices may have different injection angles and may be offset with respect to one another by a circumferential angle. In such a case, initially when the injected volume and the load on the internal combustion engine are low, only a certain number of injection orifices having a narrow injection angle may be opened, so that a fuel injection jet may be formed that is made up of fuel jets from those injection orifices having an overall narrow injection angle. As the load on the combustion engine increases and the demand on the stratified charge operation of a combustion engine running according to the lean-burn concept rises correspondingly, the injection orifices of the additional orifice circle may also be opened. These may be arranged over a larger injection angle. The fuel injection jet that is injected overall may be delivered over a larger angle.

An example embodiment of the fuel injector according to the present invention is illustrated in simplified form in the drawings and is explained in greater detail in the following description.

DETAILED DESCRIPTION

Figure 1:
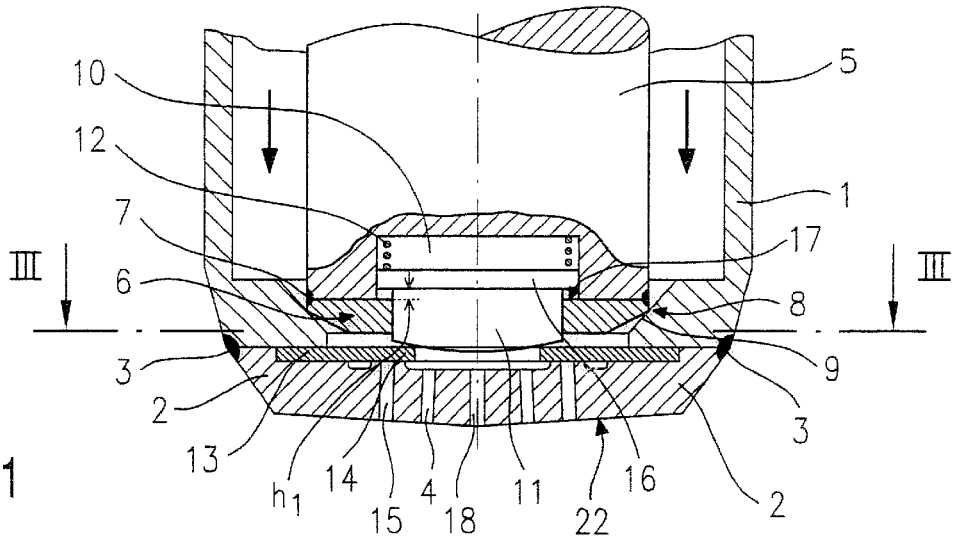
FIG. 1 illustrates a section through an example embodiment of a fuel injector according to the present invention, in the unactuated state.

FIG. 1 illustrates a section through a portion of an injector according to the present invention which faces the combustion chamber of an internal combustion engine.

A valve body 1 may be connected by welded seam 3 to injection orifice plate 2 having injection orifices 4, and together they may form valve seat body 22. The extremity of valve needle 5 facing the combustion chamber may be furnished with valve-closure member 6. This valve-closure member 6 may be connected to valve needle 5 via welded seam 7. Valve-closure member 6 may cooperate with valve seat surface 8 having, for example, a truncated conical shape, may be provided in valve body 1 to form sealing seat 9. A pressure element 11 may be located in an interior recess 10 in valve needle 5, and may be pressed against valve needle 5 via a spring 12. Pressure element 11, which in this example embodiment may have the form of a stepped cylinder, presses on a spring element, here disc spring 13, which may have a plurality of tongues 14 extending radially towards the middle. Pressure element 11 presses on the inner extremity of these tongues 14. In this manner, disc spring 13 may be pressed onto valve seat body 22, in the illustrated example embodiment towards injection orifice plate 2.

FIG. 1 illustrates the fuel injector in the closed state. Disc spring 13 is pressed flat by pressure element 11, deformed from its shape in the unloaded condition, and tongues 14 cover outer injection orifices 15 that may be arranged beneath tongues 14.

Pressure element 11 may have a collar 16 that may be used as a stop. Valve-closure member 6, which may be connected to valve needle 5 by welded seam 7, may form shoulder 17 in recess 10 that may be used as the opposing stop. When valve needle 5 has completed partial stroke $h_1$, collar 16 and shoulder 17 may be in contact with one another.

Figure 2:
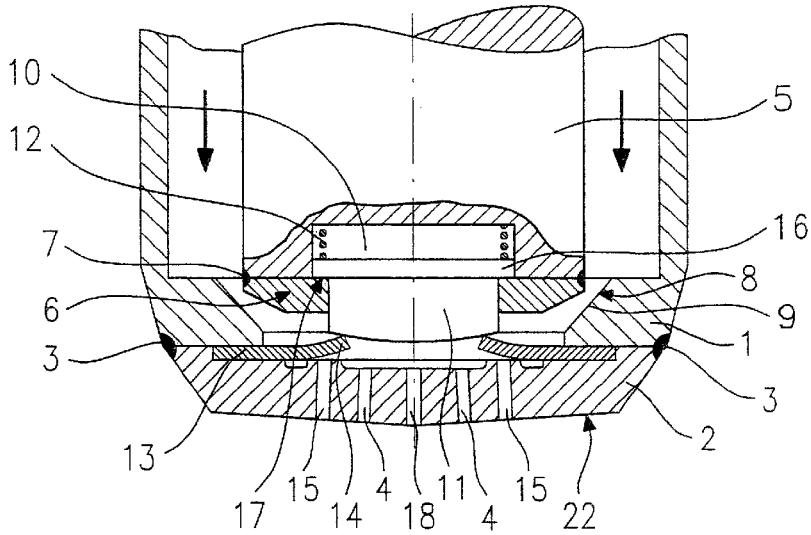
FIG. 2 illustrates a section through the example embodiment of a fuel injector according to the present invention as illustrated in FIG. 1, in the actuated state.

FIG. 2 illustrates the same example embodiment of the present invention. The drawing represents the same cutaway section, so the same reference numbers are used to indicate the same components. In this figure, the fuel injector is in the fully open condition.

In the fully open condition, collar 16 is in contact with shoulder 17 and pressure element 11 is moved by valve needle 5. Disc spring 13 rests on valve seat body 22, in this example embodiment on injection orifice plate 2. Unlike its position with the fuel injector in the closed state, as illustrated in FIG. 1, pressure element 11 is lifted from injection orifice plate 2 over collar 16 and shoulder 17 that rests on collar 16 by valve needle 5, and no longer exerts any pressure on tongues 14 of disc spring 13. Disc spring 13 there assumes its pre-tensioned shape and opens up injection orifices 15 that may be arranged beneath tongues 14 and may have been hitherto covered by tongues 14.

Figure 3:
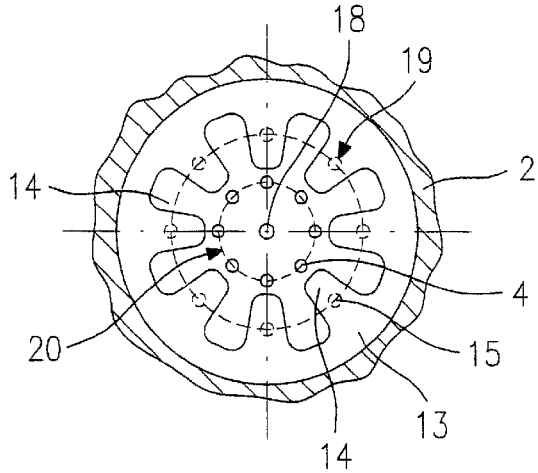
FIG. 3 illustrates a top view of section along line III—III in FIG. 1.

FIG. 3 illustrates a section along line III—III in FIG. 1. Injection orifices 4 and a central injection orifice 18, as well as the injection orifices 15 that may be covered by tongues 14 of disc spring 13, may be situated in injection orifice plate 2; in the top view, injection orifices 15 may be concealed by tongues 14 and may be therefore indicated by broken lines. These covered injection orifices 15 may be situated in a first outer orifice circle 19 whose average circumference may be indicated with a broken line. Injection orifices 4 which are not covered may be arranged in a second, inner orifice circle 20, whose average circumference may also be indicated with a broken line. Disc spring 13 is illustrated in the compressed state, corresponding to a fully closed fuel injector. In this state, all tongues 14 are in contact with injection orifice plate 2.

When the fuel injector is in the closed state, all injection orifices 4, 15 are sealed by sealing seat 9. When valve needle 5 is raised out of sealing seat 9 by an electromagnetic, piezoelectric, or magnetostrictive actuator, the fuel supply to injection orifices 4 and central injection orifice 18 is enabled, but injection orifices 15 are covered by tongues 14 of disc spring 13 and remain closed. Pressure element 11 presses tongues 14 against injection orifice plate 2 and closes covered injection orifices 15.

After partial lift $h_1$, (FIG. 1) of valve needle 5, collar 16 of pressure element 11 strikes against shoulder 17 in valve needle 5. As valve needle 5 continues the lift, pressure element 11 may be lifted away from injection orifice plate 2. Tongues 14 deflect away from injection orifice plate 2 due to the natural tension of disc spring 13, and open injection orifices 15, which have hitherto been covered. The distance by which tongues 14 deflect upwards may be determined by the further length of the lift. However, this also influences the flow cross-section to covered injection orifices 15. If valve needle 5 is only raised by a stroke smaller than $h_1$, only injection orifices 4, which are not covered, may be opened if the spring force of spring 12 is designed to be greater than the spring force of disc spring 13.

If the angle at which covered injection orifices 15 and uncovered injection orifices 4, 18 are disposed is varied, the overall angle of a fuel injection cone may be modified. The example embodiment according to the present invention of a fuel injector may enable high switching frequency; the low masses set in motion may allow rapid response. The design according to the invention may be inexpensive to implement.

In a further example embodiment, disc spring 13 may be shaped with suitable surfaces such that it may cover not only the injection orifices of first circle 19, but also the injection orifices of second circle 20, and injection orifices 4, 15 of the different circles 19, 20 may be uncovered consecutively when tension is removed, in that as tension is progressively removed, parts of disc spring 13 may deflect upwards and uncover circle 20 before the reduced tension allows different parts of disc spring 13 to deflect upwards and uncover the other circle 19.

What is claimed is:

1. A fuel injector for a fuel injection system in an internal combustion engine, comprising:

a valve seat body having a valve seat surface; and a valve needle having a valve-closure member which cooperates with the valve seat surface to form a sealing seat;

wherein the valve seat body has a plurality of injection orifices isolated from the fuel supply by the sealing seat being disposed downstream from the sealing seat, and wherein the valve-closure member has a pressure element in a recess facing the valve seat body, which pressure element applies pre-tension to a spring element so that at least one of the injection orifices is covered by the spring element, and the spring element uncovers the at least one of the injection orifices when the tension exerted by the pressure element is removed.

2. The fuel injector according to claim 1, wherein the pressure element has a stop, with which an opposing stop of the valve-closure member comes into contact after a partial lift of the valve-closure member, and which raises the pressure element away from the valve seat body with an additional lift.

3. The fuel injector according to claim 2, wherein the stop of the pressure element is a projecting collar and the opposing stop of the valve closing body is a shoulder in the recess of the valve closing body.

4. The fuel injector according to claim 3, wherein the spring element is a disc spring, and the disc spring has tongues oriented radially inward, and at least one tongue covers an injection orifice when the radially inner ends of the tongues are pressed against the valve seat body by the pressure element.

5. The fuel injector according to claim 4, wherein at least one of the injection orifices is arranged in a first circle covered by tongues of the disc spring.

6. The fuel injector according to claim 5, wherein at least one of the injection orifices is arranged in a second circle, disposed radially inward from the first circle, and the at least one injection orifice of the second circle is covered by appropriately shaped section on the disc spring.

7. The fuel injector according to claim 6, wherein the disc spring is shaped so that it uncovers injection orifices of the different circles consecutively when tension is removed.

8. The fuel injector according to claim 7, wherein the injection orifices have differing injection angles.

9. The fuel injector according to claim 8, wherein the injection orifices have at least one of differing aperture diameters and differing axial lengths.

10. The fuel injector according to claim 9, wherein the valve needle is actuatable using one of an electromagnetic actuator and a piezoelectric actuator.

11. The fuel injector according to claim 10, wherein the injection orifices are provided in an injection orifice plate which is attached to a valve body having a sealing seat.

* * * * *